US011634943B2

(12) United States Patent
Gombo et al.

(10) Patent No.: US 11,634,943 B2
(45) Date of Patent: Apr. 25, 2023

(54) MULLION JOINERY FOR WINDOW FRAME ASSEMBLY

(71) Applicant: JELD-WEN, Inc., Charlotte, NC (US)

(72) Inventors: Yoshua Gombo, Seattle, WA (US); Jerry Jones, Klamath Falls, OR (US); Jacob Nelson, Klamath Falls, OR (US); David Belau, Klamath Falls, OR (US); Ryan Schroeder, Klamath Falls, OR (US); Nick Strahm, Klamath Falls, OR (US)

(73) Assignee: JELD-WEN, INC., Charlotte, NC (US)

( * ) Notice: Subject to any disclaimer, the term of this patent is extended or adjusted under 35 U.S.C. 154(b) by 423 days.

(21) Appl. No.: 16/926,501

(22) Filed: Jul. 10, 2020

(65) Prior Publication Data

US 2021/0010321 A1 Jan. 14, 2021

Related U.S. Application Data

(60) Provisional application No. 62/873,785, filed on Jul. 12, 2019.

(51) Int. Cl.
*E06B 3/96* (2006.01)
*E06B 7/14* (2006.01)

(52) U.S. Cl.
CPC ..... *E06B 3/9616* (2013.01); *E06B 7/14* (2013.01)

(58) Field of Classification Search
CPC ..... E06B 3/9616; E06B 3/9642; E06B 7/14; E06B 1/366; E06B 1/524
See application file for complete search history.

(56) References Cited

U.S. PATENT DOCUMENTS 3,782,064 A * 1/1974 Hubbard ..... E04B 1/70 52/775
2010/0192488 A1* 8/2010 Campbell ..... E06B 1/366 52/204.5

FOREIGN PATENT DOCUMENTS

CA 2928085 A1 * 11/2016 ..... E06B 1/524
CH 0181285 A1 * 10/1985
EP 1035294 A2 * 9/2000 ..... E06B 3/9616
GB 2310240 A * 8/1997 ..... E06B 3/9616

OTHER PUBLICATIONS

Andersen Windows and Doors, 100 Series Windows Information Sheet, available at least as of Jul. 12, 2019, 2 pages.
Jeldwen, Inc , Photos of Interior Components of Andersen 100 Series Windows, product available at least as of Jul. 12, 2019, 3 pages.

(Continued)

*Primary Examiner* — Adriana Figueroa
(74) *Attorney, Agent, or Firm* — Lorenz & Kopf, LLP

(57) ABSTRACT

The disclosure relates generally to a window assembly designed to facilitate the construction process by providing a simple and efficient method for joining mullion members and frame members along a window joint. The assembly includes a mullion end cap with a seal extending around the periphery of the end cap to help minimize moisture entry into the window assembly via the window joints. In addition, the seal includes fastener bosses designed to seal against fasteners extending therethrough to help seal the joint without need for separately applying a silicone or other sealant in a post-assembly process.

20 Claims, 8 Drawing Sheets

(56) References Cited

OTHER PUBLICATIONS

Andersen Windows and Doors, 100 Series Windows and Doors, 2017-18 Product Guide for Professionals, published at least as of Jun. 27, 2017, 107 pages (see pp. 23, 27, 47, 59, & 75).
Jeld-Wen, Inc., Photos of Interior Components of Andersen 100 Series Windows, product publicly available in the USA at least as of Sep. 27, 2017, 3 pages.

* cited by examiner

MULLION JOINERY FOR WINDOW FRAME ASSEMBLY

RELATED APPLICATION DATA

This application is a nonprovisional of and claims the benefit under 35 U.S.C. § 119(e) of U.S. Provisional Patent Application No. 62/873,785 filed Jul. 12, 2019, the disclosure of which is incorporated by reference herein in its entirety.

TECHNICAL FIELD

The field of this disclosure relates generally to window frame assemblies, and particularly, to joinery assemblies designed for facilitating expedient coupling of window frame and mullion members. In addition, the joinery assemblies are designed to provide effective water performance and improved durability of the window frame along the frame and mullion joints without the need of applying sealants to the joint.

BACKGROUND

Window frames are generally designed to structurally support glass panes and to resist water penetration and leaks. Some conventional simple window assemblies include four frame members arranged to support a single glass pane therebetween, while other more involved window frame assemblies incorporate mullions and several glass panes arranged to provide a more intricate and aesthetically pleasing design. As window designs have grown more complex over time, their associated construction processes have become more challenging and time consuming due to an increase in components being used and the need to maintain proper structural stability and water performance of the overall assembly. Accordingly, there is a need for an efficient building process that minimizes overall costs by eliminating unnecessary components while also expediting the building process and improving long-term performance of the window assembly. Water performance is especially important in the more complex window assemblies because such assemblies tend to include multiple joints where frame members come together, where each of these joints represents a potential intrusion point for water.

For many conventional window frames, one of the simplest and most efficient construction processes is to join mullion and frame members with fasteners that extend through both members. Such coupling techniques, however, often lead to issues with frame joints leaking at the point of fastener penetration due to improper sealing. One potential solution to minimize such leakage is to seal the joint after assembly by applying silicone or using another sealant to seal the fastener openings. While this sealing technique may be effective at minimizing water intrusion at the joint, such seals make it difficult to access the fasteners when replacement of damaged frames or mullions is required. In addition, these seals may trap any water that has penetrated the frame or mullions, which may result in long-term damage to the frame assembly since the water has no outlet points.

Accordingly, the present inventors have identified a need for improved construction methods of window assemblies both to facilitate the construction process and to provide improved sealing. The present inventors have also identified a need for such an assembly designed to minimize water intrusion into the frame, while also providing exit points to allow any intruding water to drain out of the frame. Additional aspects and advantages will be apparent from the following detailed description of example embodiments, which proceeds with reference to the accompanying drawings.

DETAILED DESCRIPTION OF EXAMPLE EMBODIMENTS

With reference to the drawings, this section describes embodiments of a window assembly and its detailed construction and operation. Throughout the specification, reference to "one embodiment," "an embodiment," or "some embodiments" means that a described feature, structure, or characteristic may be included in at least one embodiment of the window assembly. Accordingly, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring more pertinent aspects of the embodiments being discussed.

FIGS. 1-9 collectively illustrate various embodiments and components of a window assembly 10. As further described in detail below, the window assembly 10 and its various components are designed to facilitate its construction process by providing a simple and efficient method for joining mullion members 22, 24 to frame members 14, 16, 18, 20 of the window assembly 10. In addition, the window assembly 10 is designed to provide improved overall water sealing performance of the window assembly 10 without requiring application of additional sealants at the window joints 28.

Figure 1:
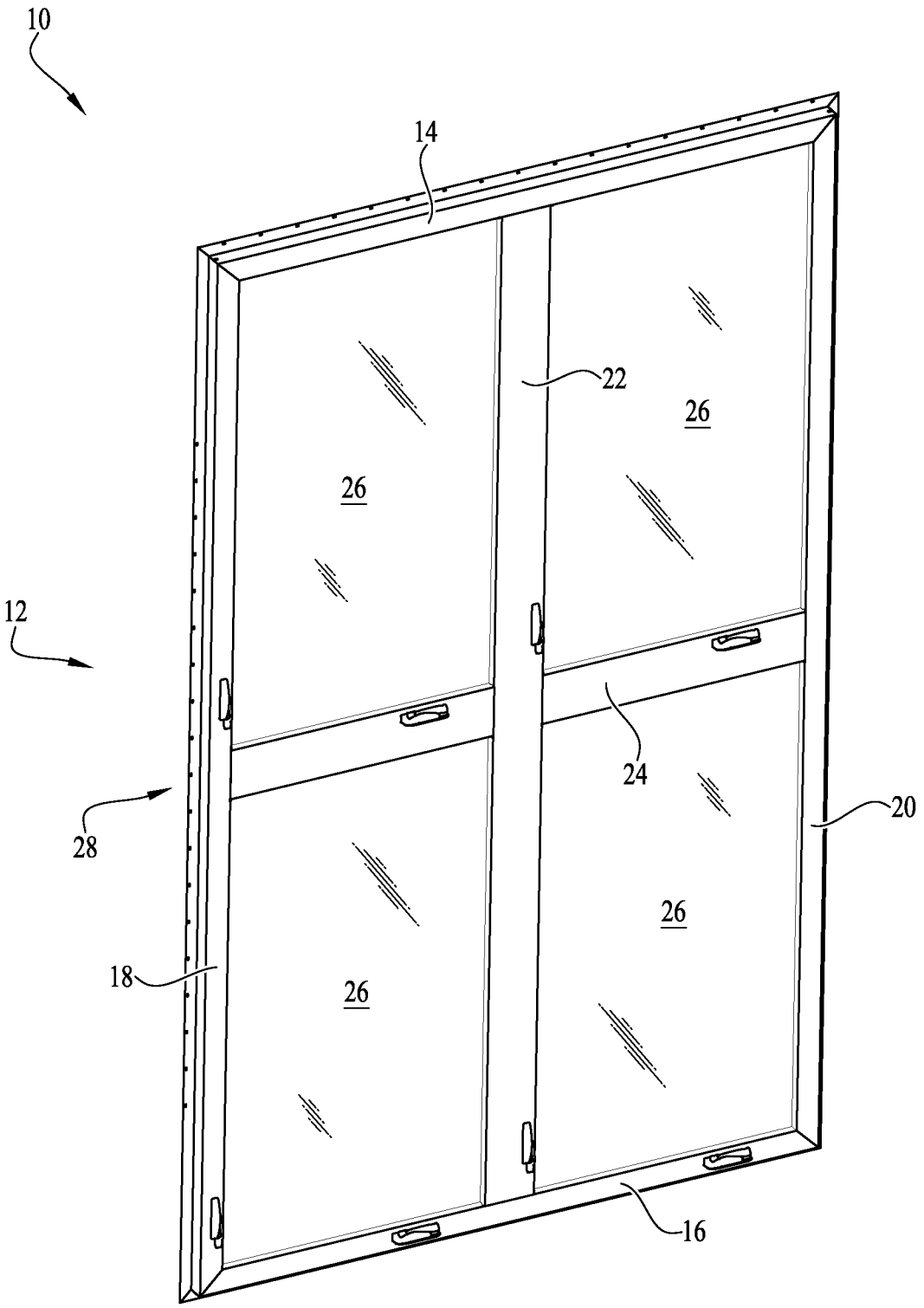
FIG. 1 is a pictorial view of a window assembly in accordance with one embodiment.
Figure 2:
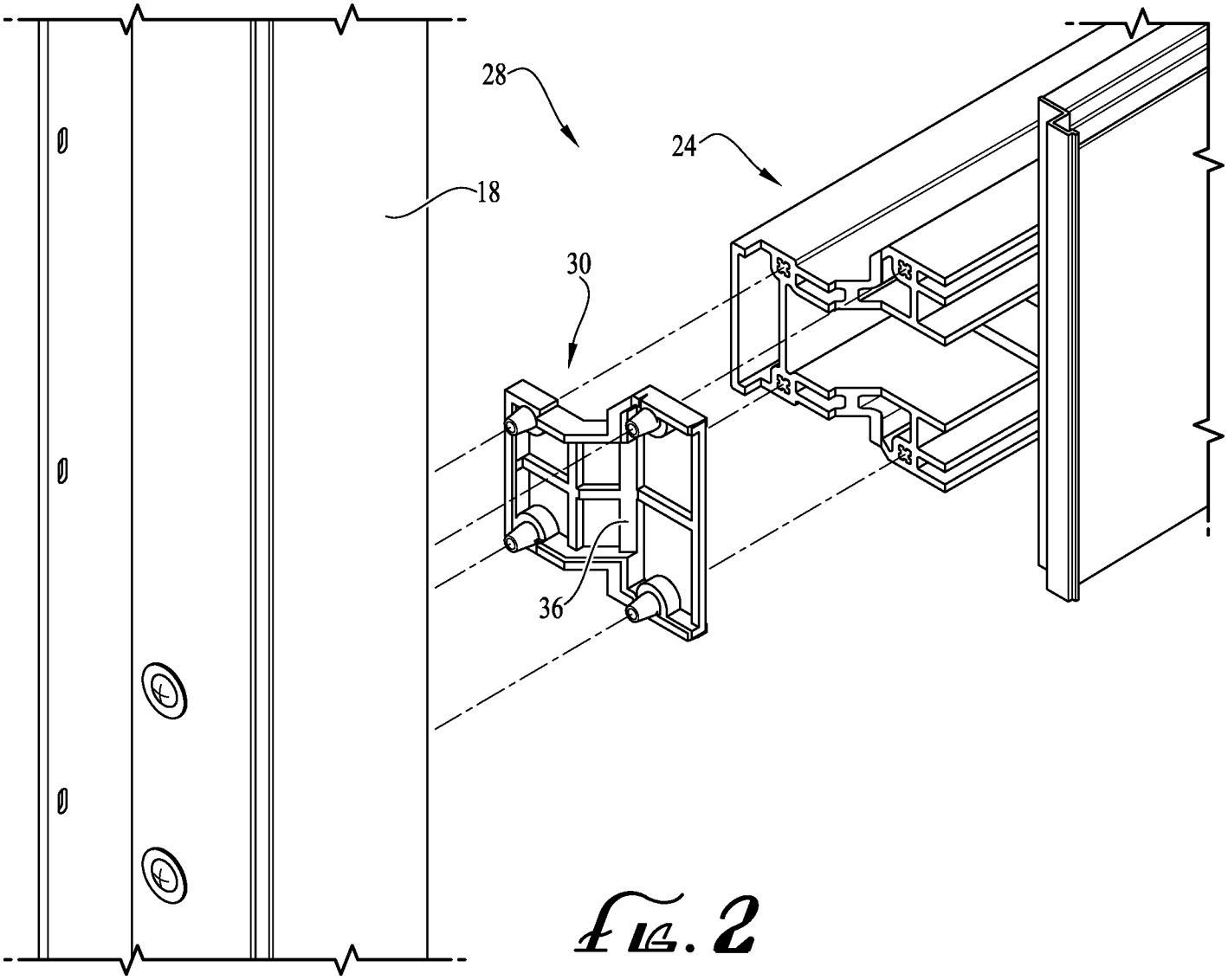
FIGS. 2-3 are partial exploded views of the window assembly of FIG. 1 with both views focusing on a frame and mullion joint to illustrate various details of a mullion end cap designed to facilitate coupling of the mullion and frame members and provide improved water sealing performance.
Figure 4:
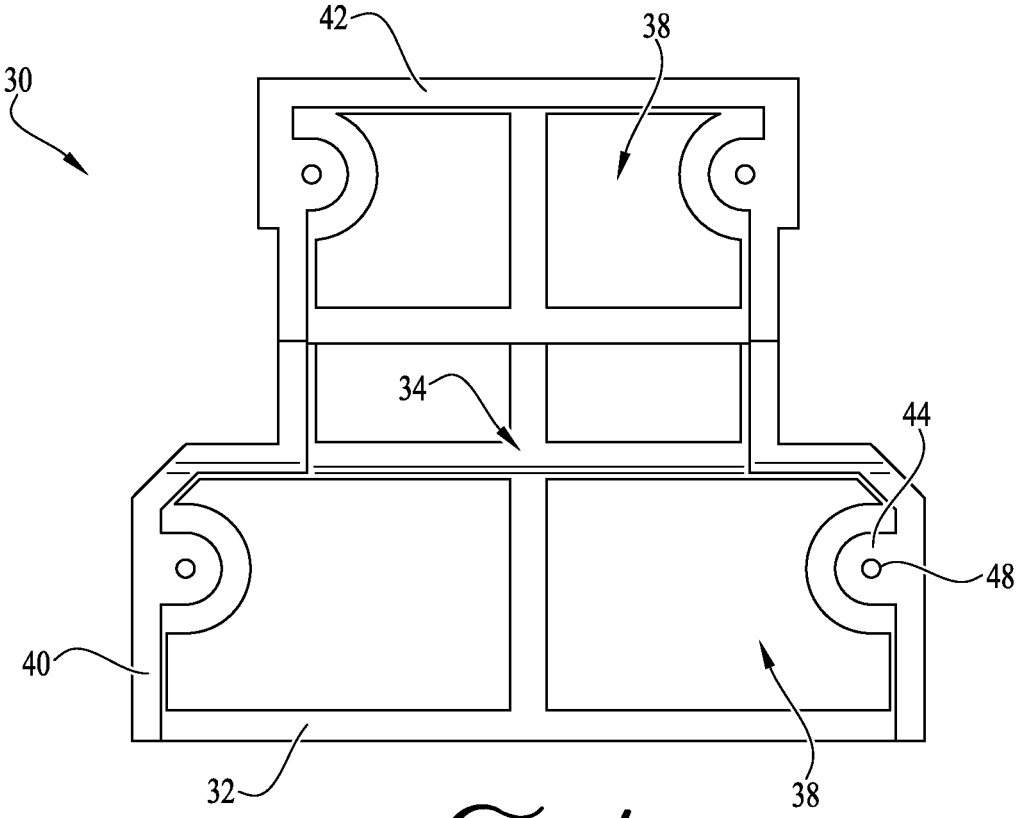
FIGS. 4-5 illustrate views of the mullion end cap of FIGS. 2-3 in accordance with one embodiment.
Figure 5:
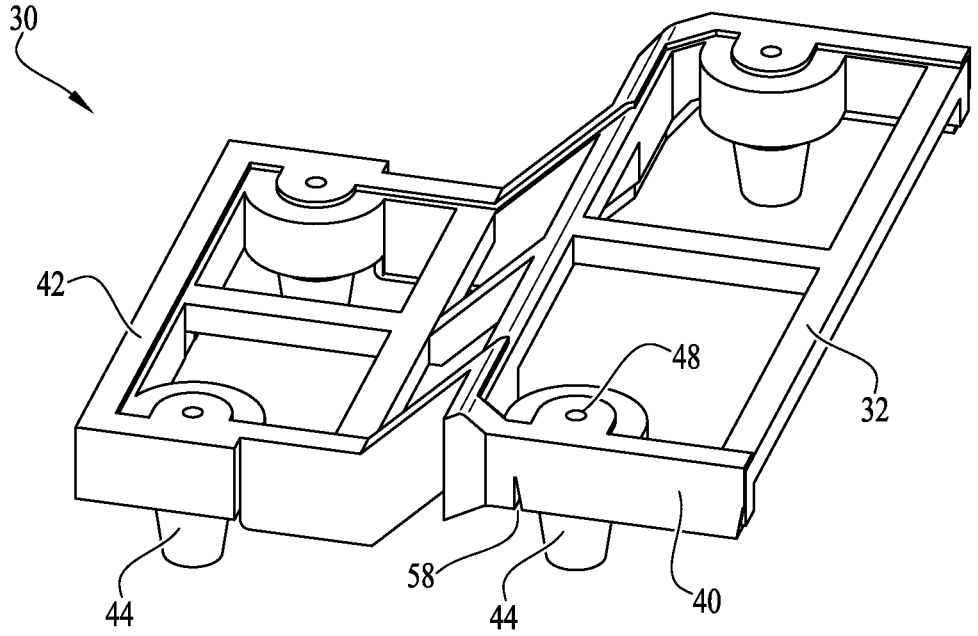

Turning briefly to FIGS. 2 and 4, the window assembly 10 includes a mullion end cap 30 with a molded seal 40 extending around a portion (or entirety) of the body 32 of the mullion end cap 30. The seal 40 is designed to minimize moisture entry into the window assembly 10 at a window joint 28, and to provide drainage means for removing any water that may have entered the window assembly 10. In a completed assembly, the end cap 30 is coupled between the frame members 14, 16, 18, 20 and the mullions 22, 24 at their respective joints 28 (only one shown in FIG. 1 for simplicity). The seal 40 includes fastener bosses 44 designed to receive fasteners 56 therethrough, and seal against the fasteners 56 after penetration to help seal the window assembly 10 at the joint 28 without need for separately applying a silicone or other sealant. Not only is sealing the hardware important for overall water performance of the window assembly 10, but allowing water to flow out of the mullions 22, 24 also improves its long term durability.

Figure 10:
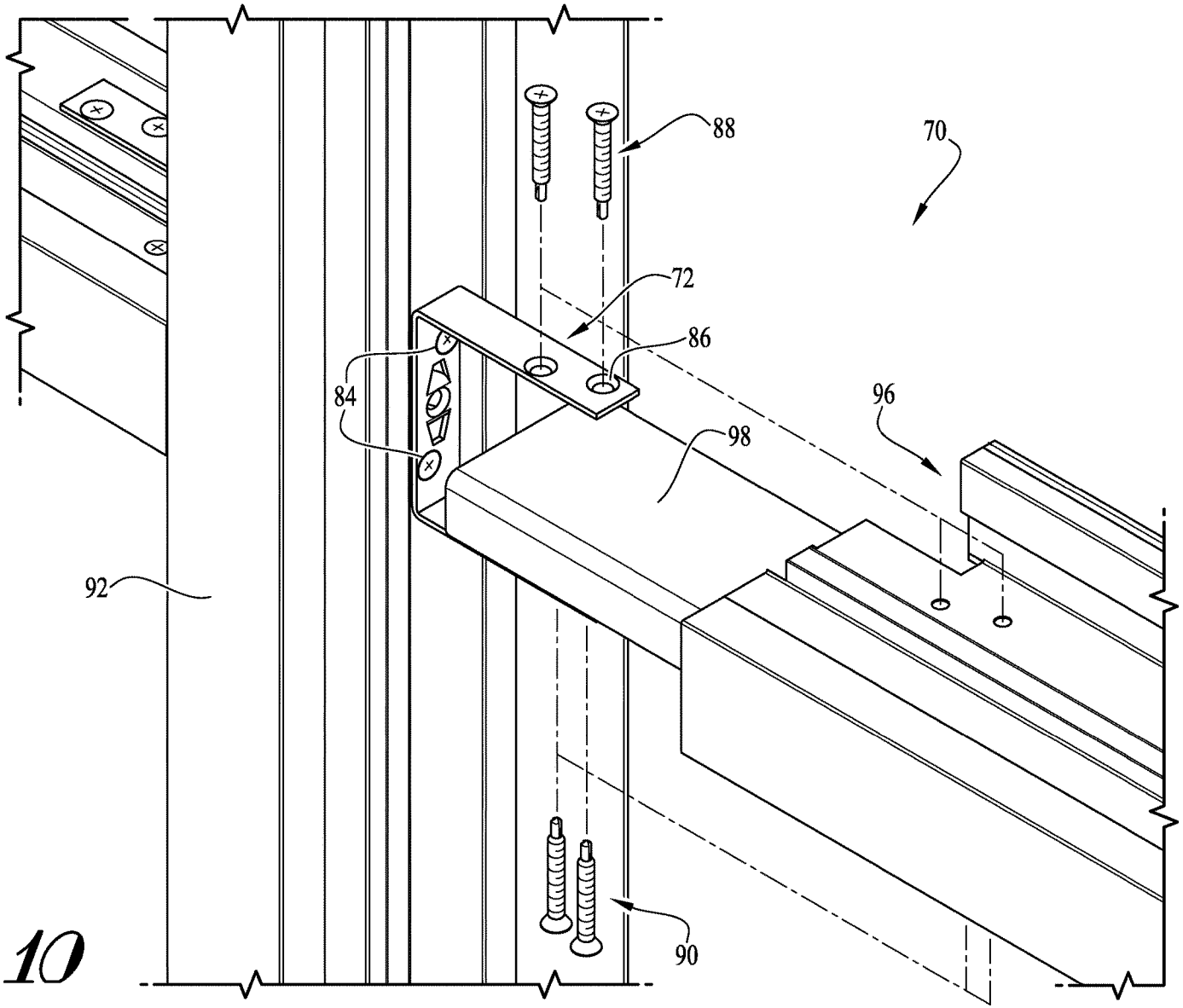
FIGS. 10 and 11 collectively illustrate views for a connection mechanism to facilitate the joining of mullion members to one another in accordance with another embodiment.
Figure 11:
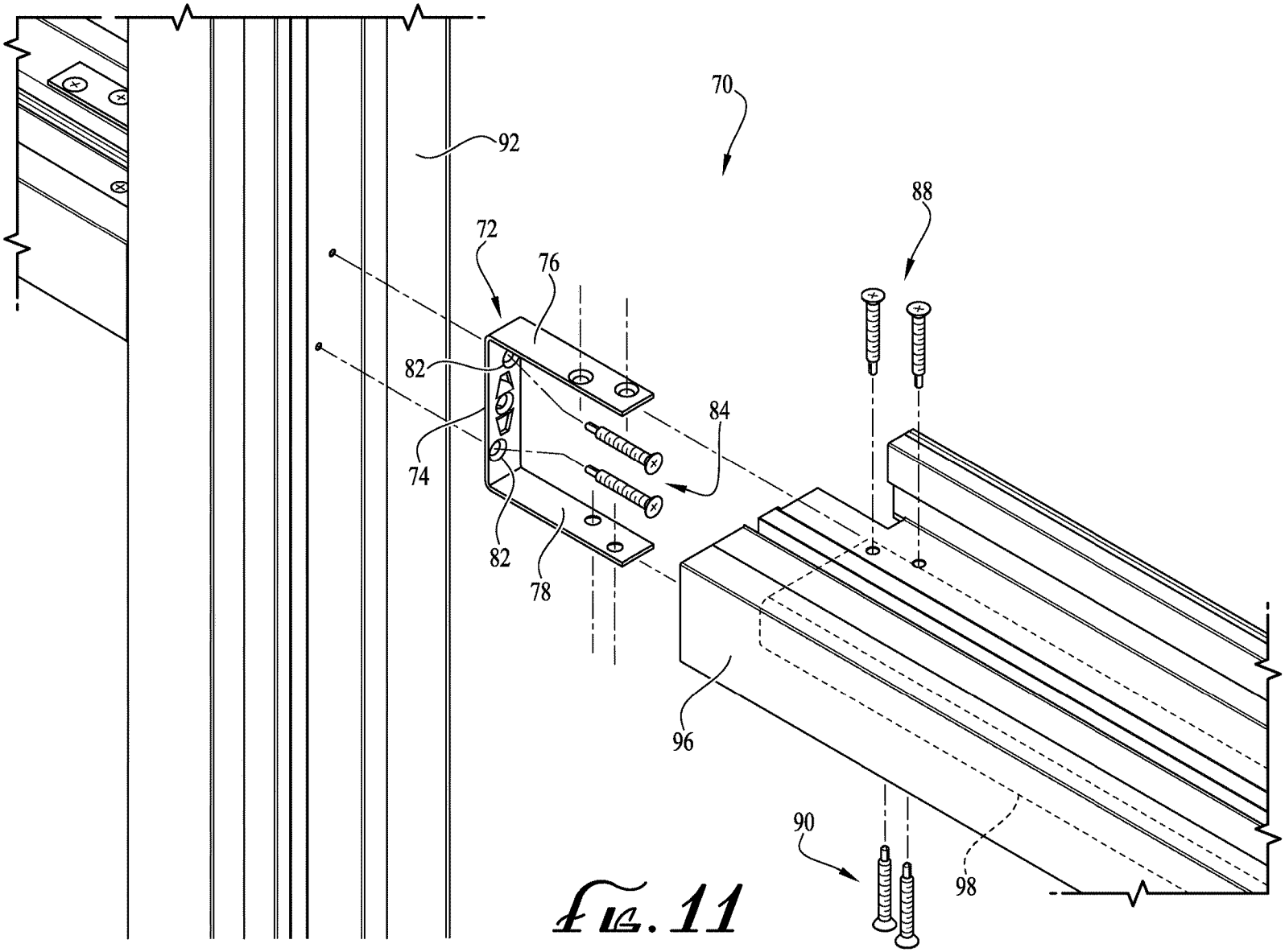

Turning briefly to FIGS. 10-11, the figures collectively illustrate views of a connection system 70 designed for joining mullion members 92, 96 of a window assembly (not shown) to one another in accordance with another embodiment. As further described in detail below, the connection system 70 accommodates connection of two mullion members 92, 96 without having to bolt all the way through either mullion 92, 96. Briefly, the system 70 includes a U-shaped bracket 72 that attaches to both mullions 92, 96 and engages their respective reinforcement members 98 (reinforcement member for mullion 92 not shown). This overall design allows the load path to pass through the stronger mullion reinforcement members 98 instead of relying solely on the mullion material, which may result in a weak and unstable joint. Additional details of each of these components and other embodiments relating to the window assembly 10 are described in further detail below with reference to the figures.

Turning first to FIG. 1, the following provides a brief overview of a general configuration of the window assembly 10. FIG. 1 illustrates a window assembly 10 including a window frame 12 adapted to be secured within an opening of a building or housing structure. The frame 12 includes a pair of frame members 14, 16 each extending horizontally and connected at their respective ends by a pair of vertically extending frame members 18, 20 to form a generally rectangular assembly. The window frame 12 includes a first mullion 22 extending between and connected at its opposite ends to frame members 14, 16, and a second mullion 24 extending between and connected at its opposite ends to frame members 18, 20, where the mullions 22, 24 cross over one another at a general midpoint of the window frame 12. The window frame 12 supports a plurality of glass panes 26 between the frames 14, 16, 18, 20 and the mullions 22, 24. It should be understood that the embodiment of the window assembly 10 of FIG. 1 is for illustration purposes only and not intended to be limiting. In other embodiments, the window frame 12 may include additional mullions disposed in a different arrangement as desired.

Figure 3:
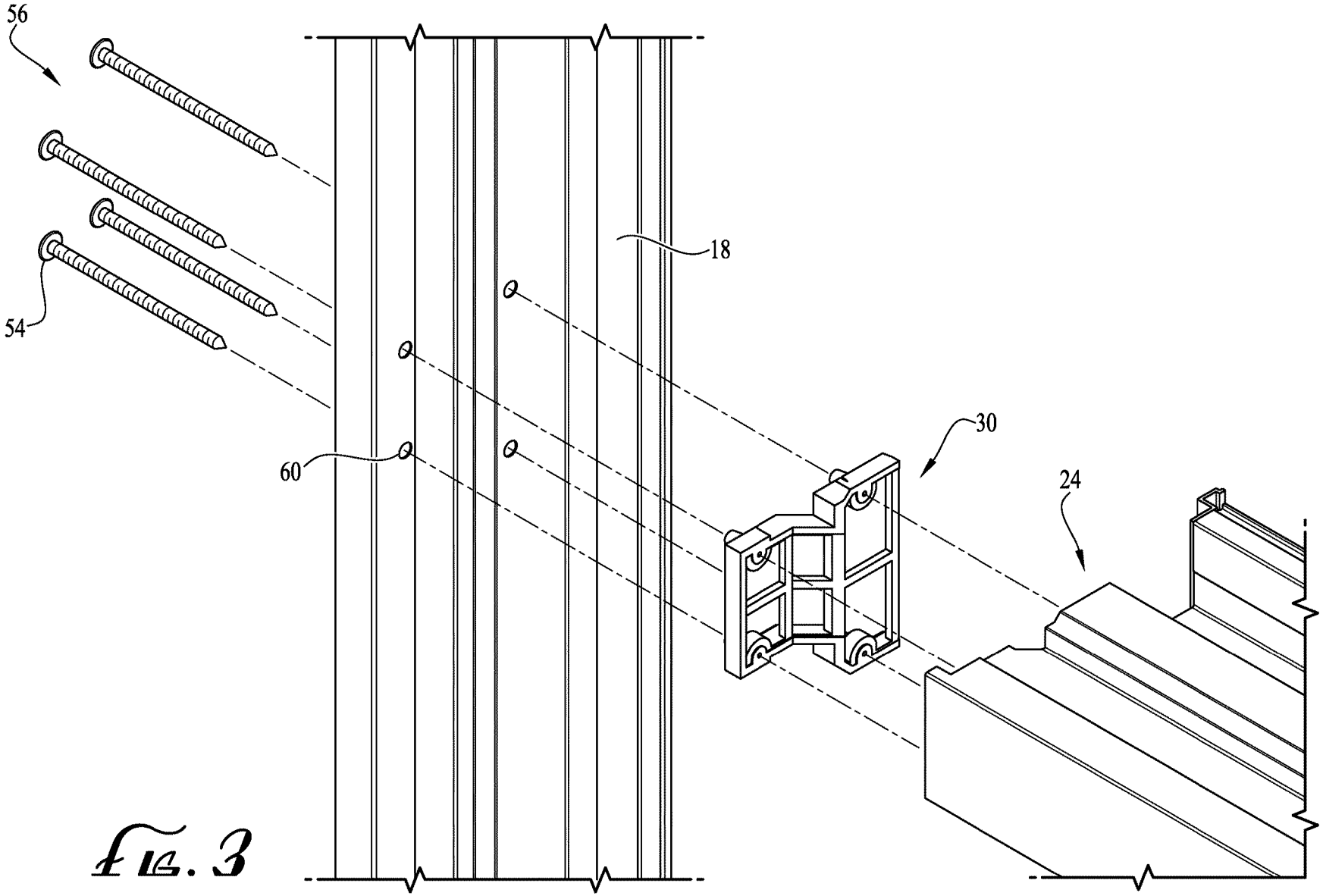

With reference to FIGS. 2-3, the following discussion briefly introduces the primary components of the window joint 28 followed by a more detailed discussion of these components with collective reference to FIGS. 4-9 focusing on the mullion end cap 30 and its features for providing improved water performance of the window assembly 10. Turning to FIGS. 2-3, the partial exploded views illustrate details of the window joint 28 formed at an intersection where a frame member 18 and mullion 24 meet. As illustrated, the window assembly 10 includes a mullion end cap 30 having a mullion-facing surface 34 (see FIG. 4) interfacing with the mullion 24, and a frame-facing surface 36 (see FIG. 2) interfacing with the frame member 18 in a completed assembly as further described in detail below. As noted previously, the mullion end cap 30 includes various features designed to minimize moisture entry into the window assembly 10 at the joint 28, and to provide drainage features for removing any water that may have entered. Although the following details are described with primary reference to the window joint 28 illustrated in FIG. 1, it should be understood that the same details apply to any other joints of the window frame 12 where the other frame members and mullions meet.

With reference to FIG. 4, the mullion end cap 30 includes a body 32 preferably manufactured as an injection molded, single integral structure made of any suitable material, such as high-density polyethylene (HDPE) or other suitable plastic material. The body 32 may be designed with various supporting ribs or legs interlaced with other one another with large voids between the ribs or legs, or may instead be designed as a more solid component for additional rigidity (not shown) as desired. Regardless of its overall structural design, the body 32 includes a mullion-facing surface 34 and an opposite frame-facing surface 36 as noted previously (see FIG. 2). The respective surfaces 34, 36 are designed with specific surface features and overall profiles for ensuring a flush fit against the respective mullion 24 and frame member 18 when the components are brought together, and the frame is fully assembled (see FIGS. 2 and 3). For example, in one embodiment, the mullion 24 may have a generally T-shaped cross-section (sometimes referred to as a T-mullion), and consequently the mullion-facing surface 34 is also formed with a corresponding T-shape profile, where the body 32 has a narrower lower portion and a wider upper portion. Similarly, the frame-facing surface 36 is formed with various surface details and profile such that the mullion end cap 30 sits flush against the frame 18 when coupled. It should be understood that the particular design of the mullion profile and the mullion end cap 30 are for illustration purposes only and not intended to be limiting. One having ordinary skill in the art may make changes to the overall mullion profile and mullion end cap 30 without departing from the principles of the disclosed subject matter.

The mullion end cap 30 include a plurality of slots or openings 38, where each opening 38 extends entirely through the body 32 from the mullion-facing surface 34 to the frame-facing surface 36 to provide an open passage on the end cap 30. When the mullion end cap 30 is seated against the mullion 24, the openings 38 communicate with open chambers (not shown) formed within the interior space of the mullion 24. In this arrangement, the openings 38 allow water to flow outwardly from the interior of the mullion 24 through the end cap 30 and toward the frame member 18 to provide drainage for removing water present within the mullion 24.

With collective reference to FIGS. 4-9, the mullion end cap 30 includes a seal 40 surrounding or covering some or all of the peripheral side edges of the body 32. The seal 40 may be a thermoplastic elastomer, such as rubber, or any other suitable material selected for its sealing performance properties. As illustrated in FIG. 4, a portion of the seal 40 may extend onto both the mullion-facing surface 34 and the frame-facing surface 36 to form a border or lip 42 along the edges of the surfaces 34, 36 of the body 32. The lip 42 may extend onto the surfaces 34, 36 for any suitable distance measured from the edges of the body 32 as desired, but preferably the distance should be sufficient to ensure that the seal 40 is firmly in place on the body 32 and that the mullion end cap 30 creates a suitable seal to minimize water intrusion. Preferably, the lip 42 is offset from the slots 38 formed on the body 32 to avoid interruption with the water performance of the mullion end cap 30.

Figure 8:
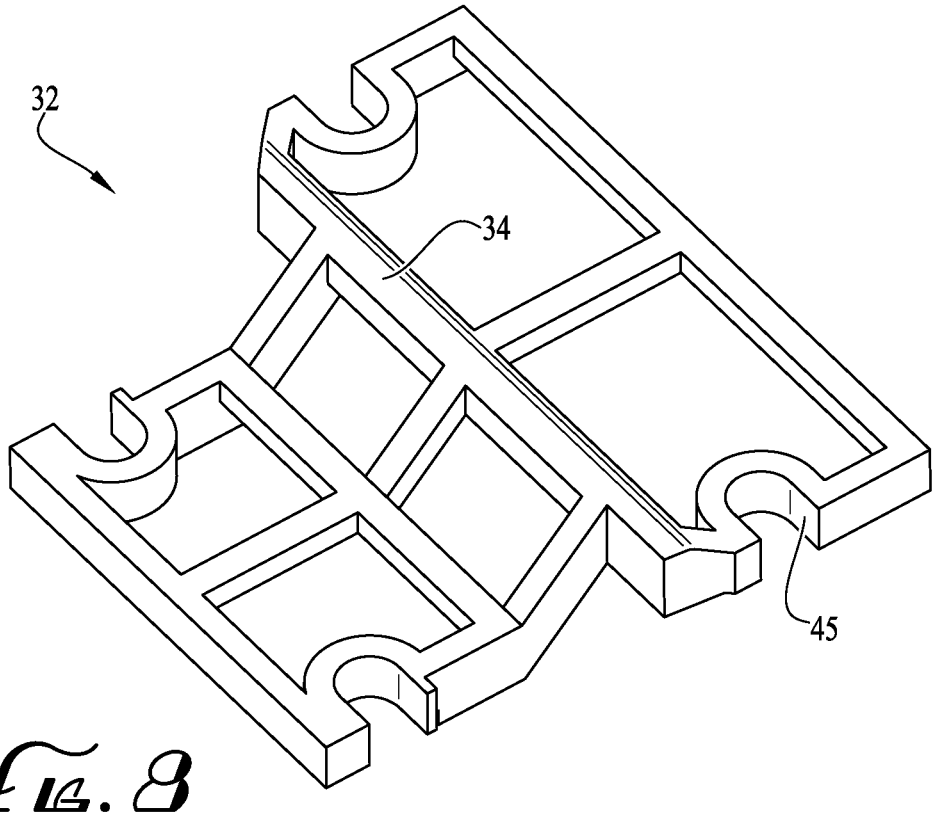
FIGS. 8 and 9 are views of a separated body and seal components, respectively, of the mullion end cap of FIG. 4.
Figure 9:
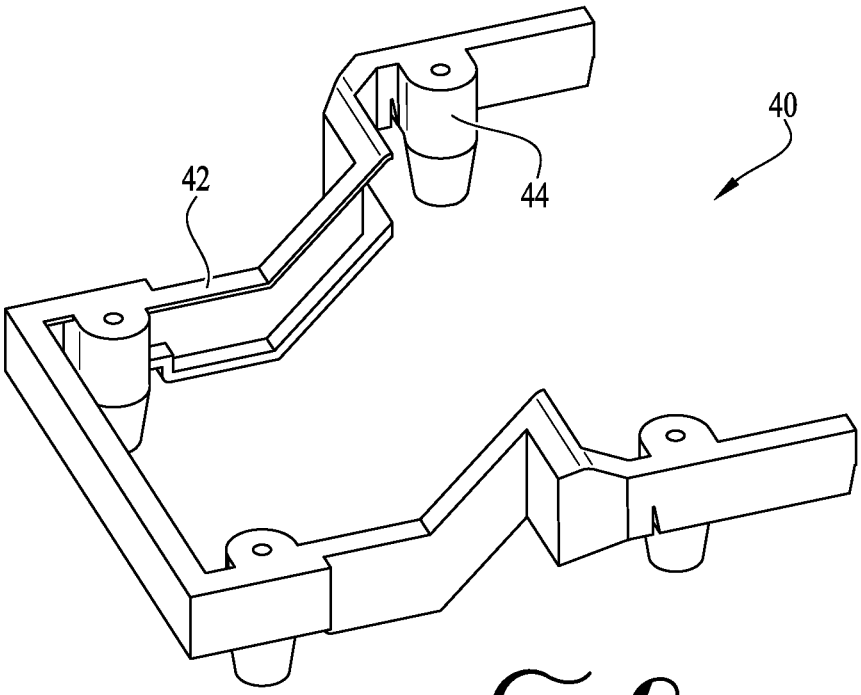

As best illustrated in FIG. 9, the seal 40 further includes integrated fastener bosses 44 spaced apart from one another, where the bosses 44 are designed to sit substantially flush against corresponding cutouts 45 formed on the body 32 (see FIG. 8) when the seal 40 and body 32 are coupled along the mullion-facing surface 34. When the components are coupled, the bosses 44 each extend outwardly/downwardly and beyond the frame-facing surface 36 of the body 32.

Figure 6:
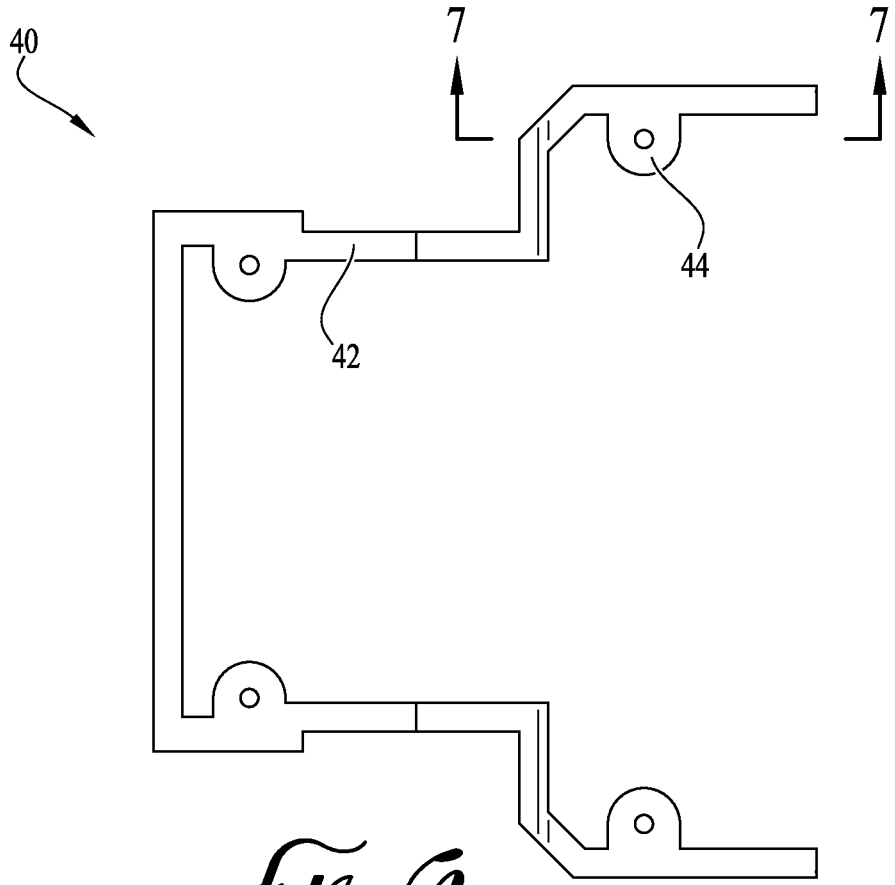
FIG. 6 illustrates a seal surrounding the mullion end cap and FIG. 7 is a cross-sectional detail view of the seal cut along sectioning lines 7-7 of FIG. 6 illustrating details of a sealing fastener boss.
Figure 7:
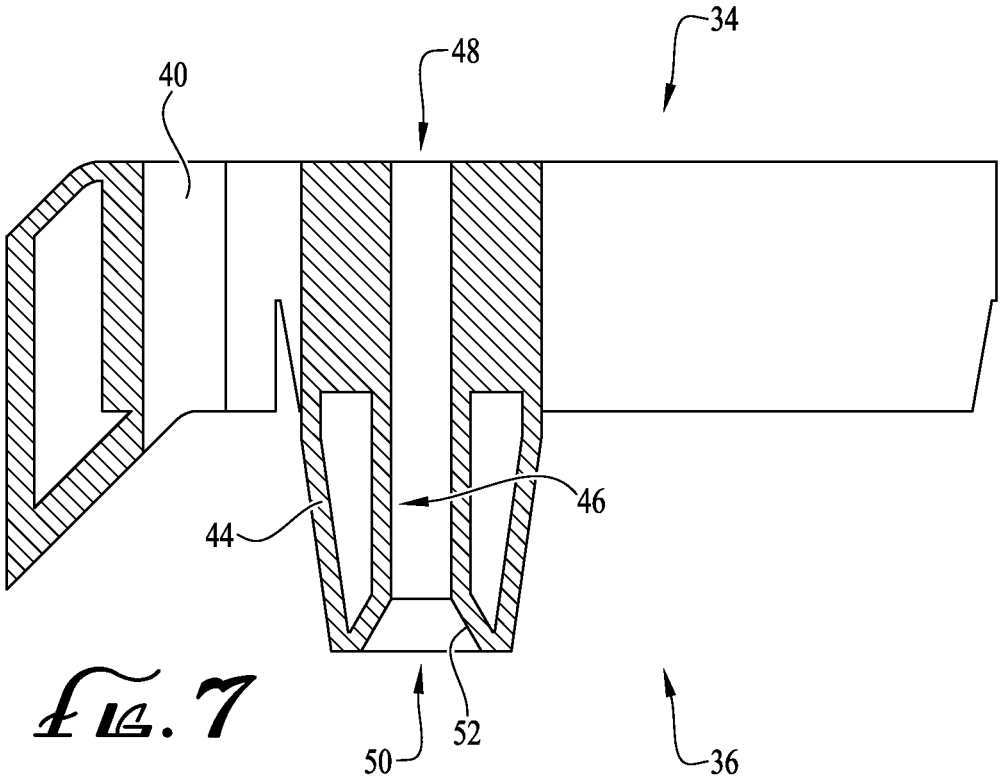

FIG. 7 is a cross-section view taken along sectioning lines 7-7 of FIG. 6 illustrating additional detail relating to the fastener bosses 44. With reference to FIG. 7, the fastener bosses include a passageway 46 extending entirely therethrough, the passageway 46 having a first opening 48 along a first end of the boss 44 (the mullion-facing surface 34 when the components are coupled) and a second opening 50 along an opposite second end of the boss 44 (the frame-facing surface 34). In some embodiments, the second opening 50 includes tapered sides 52 designed to receive a correspondingly tapered head 54 of a fastener 56 (see FIG. 3) in a completed assembly. The bosses 44 are sufficiently flexible to securely receive the fasteners 56 within the passageway 46, while also seal-sealing after fastener insertion to provide a sturdy seal against water intrusion at the insertion site as further described below.

Returning to FIG. 5, a bottom surface of the seal 40 may include a plurality of slits 58 formed thereon and positioned adjacent the frame-facing surface 36 when the seal 40 is coupled to the body 32, the slits 58 designed to aid in draining water from the mullion 24 to the exterior of the window assembly 10. In some embodiments, the slits 58 are positioned adjacent the slots 38 formed on the body 32. Preferably, the slits 58 are formed only along the frame-facing surface 36, with the mullion-facing surface 34 being free from any similar slits, such that the slits 58 help promote water drainage out of the frame member 18.

With reference to FIGS. 8-9, the body 32 and the seal 40 may be manufactured as separate components and coupled together using any suitable method. For example, in one embodiment, an overmolding process may be used to couple the seal 40 to the body 32. In such embodiments, the body 32 may be molded from a rigid plastic or other suitable material, and the seal 40 may be molded onto the periphery of the body 32 to create the mullion end cap 30 with the integrated materials.

Turning to FIGS. 2 and 3, the following describes an example coupling process for joining the mullion 24 and frame member 18 together with the mullion end cap 30 at the window joint 28. With reference to the figures, the mullion end cap 30 is oriented with the mullion-facing surface 34 adjacent the mullion 24 and is seated against the mullion 24. As noted previously, the profile of the mullion 24 and the mullion-facing surface 34 correspond with one another to ensure a substantially flush coupling at the respective interface. Thereafter, the mullion 24 and mullion end cap 30 are aligned with openings 60 formed on the frame member 18, the openings 60 (see FIG. 3) corresponding with the position of the openings 50 formed on the fastener bosses 44 of the mullion end cap 30. Once the components are properly aligned, fasteners 56 are inserted through the openings 60 of the frame member 18 and into the openings 50 of the bosses 44 along the frame-facing surface 36. The fasteners 56 each extend through the passageway 46 of the respective bosses 44 and out the openings 48 formed along the mullion-facing surface 34, whereat the fasteners 56 continue and extend into the mullion 24 to securely couple the components together. The same process may be repeated at all other window joints of the window assembly 10.

As described previously, the bosses 44 of the seal 40 help securely receive the fasteners 54 to eliminate the need for applying an additional sealant after the coupling process is complete. Rather, the bosses 44 help seal the joint 28 at the fastener insertion site by providing a tight receiving fit for the fasteners 56, thereby minimizing any water intrusion. Further, the mullion end cap 30 helps prevent water intrusion into the mullion 24 at the joint 28. For any water present in the mullion 24, the slots 38 and slits 58 in the mullion end cap 30 provide drainage points for removing any intruding water.

Turning now to FIGS. 10-11, the following sections describes an embodiment for a connection system 70 for facilitating mullion-to-mullion connections for a window assembly (not shown), where the connection system 70 does not require bolting all the way through either mullion. With reference to FIGS. 10-11, the connection system 70 includes a bracket 72 having a generally planar base 74 and two legs 76, 78 extending outwardly therefrom to form a general U-shaped profile for the bracket 72. The base 74 includes a plurality of openings 82 extending therethrough, the openings 82 sized and dimensioned for receiving fasteners 84, such as self-tapping screws or other suitable fasteners. Similarly, the legs 76, 78 each include openings 86 (corresponding openings not shown on leg 78) sized and dimensioned to receive corresponding fasteners 88, 90 therethrough. The following provides additional details regarding an example assembly process for coupling the mullions 92, 96 to one another via the connection system 70.

With reference to FIGS. 10-11, the base 74 of the bracket 72 is first attached to the vertical mullion 92 via the fasteners 84 extending through the openings 82. The fasteners 84 are sufficiently long to engage the interior reinforcement member (now shown) of the vertical mullion 92 for a sturdier connection point. Once the bracket 72 is coupled to the mullion 92, an end of the horizontal mullion 96 is inserted between the legs 76, 78 of the bracket 72, and coupled thereto via the fasteners 88, 90, where the fasteners 88, 90 extend into and engage the mullion reinforcement member 98. As described, the connection system 70 allows the load path on the window assembly 10 to travel through the stronger mullion reinforcement members 98 rather than leaving a potentially weak joint that relies on the material and strength of the mullions 92, 96 themselves. Accordingly, this design minimizes structural loading through the window extrusion profile by structurally tying the mullion reinforcements 98 without requiring bolting through either one of the mullions 92, 96.

It is intended that subject matter disclosed in particular portions herein can be combined with the subject matter of one or more of other portions herein as long as such combinations are not mutually exclusive or inoperable. In addition, many variations, enhancements and modifications of the lighted shelf assembly concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. An assembly for a fenestration system comprising:

a frame including a frame member and a mullion;

an end cap including a body with a mullion-facing surface and an opposite frame-facing surface, the end cap seated against the mullion along the mullion-facing surface and seated against the frame along the frame-facing surface;

a seal coupled to the body of the end cap, the seal extending along a periphery of the body, the seal including one or more fastener bosses formed thereon, the one or more fastener bosses each having a passageway extending from the mullion-facing surface to the frame-facing surface when the seal is coupled to the body of the end cap;

one or more fasteners extending through the frame member, each fastener further extending through the passageway of a corresponding one of the one or more fastener bosses and into the mullion, wherein the fastener bosses each form a seal against the respective fastener when the frame, mullion, and end cap are coupled together; and the body of the end cap further including one or more openings extending from the mullion-facing surface to the frame-facing surface, the one or more openings being in communication with an interior portion of the mullion to provide water drainage from the interior portion of the mullion through the openings.

2. The assembly of claim 1, wherein the seal further includes one or more slits formed along the frame-facing surface, the one or more slits being in communication with the one or more openings on the body of the end cap to provide drainage from the interior portion of the mullion.

3. The assembly of claim 1, wherein the seal further includes one or more slits formed thereon for draining water from an interior portion of the mullion toward the frame.

4. The assembly of claim of claim 3, wherein the seal is free of drainage slits on the mullion-facing surface.

5. The assembly of claim 1, where the seal is a rubber seal coupled to the body via an overmolding process.

6. The assembly of claim 1, wherein the body of the end cap is manufactured as a single, integral structure.

7. The assembly of claim 1, wherein the seal is manufactured as a single, integral structure.

8. The assembly of claim 1, where the body of the end cap has a general T-shaped configuration with a narrower lower portion and a wider upper portion, the T-shaped configuration matching a corresponding profile of the mullion.

9. The assembly of claim 1, wherein the one or more fastener bosses each including a first opening formed along the frame-facing surface and a second opening formed along the mullion-facing surface of the end cap, the openings each being in communication with the passageway.

10. The assembly of claim 1, wherein the fastener bosses extend outwardly and away from the frame-facing surface of the body when the seal is coupled to the end cap.

11. A method of joining a frame member and a mullion in making a fenestration frame, the method comprising:

obtaining an end cap having a seal with one or more fastener bosses formed thereon, each of the fastener bosses having a passageway extending from a mullion-facing surface of the end cap through to a frame-facing surface, the end cap further including one or more openings extending from the mullion-facing surface to the frame-facing surface;

forming one or more apertures through the frame member; aligning the mullion-facing surface of the end cap against the mullion with the seal of the end cap seated against the mullion;

aligning the frame-facing surface of the end cap against the frame such that each of the one or more fastener bosses is aligned with a corresponding one of the one or more apertures of the frame member;

inserting a fastener through the one or more apertures of the frame member, the fastener extending through the passageway of the corresponding fastener boss and into the mullion, wherein the fastener bosses each form a seal against the respective fastener without applying a sealant; and aligning the one or more openings with an interior portion of the mullion to provide water drainage from the interior portion of the mullion through the openings.

12. The method of claim 11, wherein the seal further includes one or more slits formed along the frame-facing surface, the one or more slits being in communication with the one or more openings on the body of the end cap to provide drainage from the interior portion of the mullion.

13. The method of claim 11, wherein the seal further includes one or more slits formed thereon for draining water from an interior portion of the mullion toward the frame.

14. The method of claim 13, wherein the seal is free of drainage slits on the mullion-facing surface.

15. The method of claim 10, wherein the end cap includes a body manufactured as a single, integral structure.

16. The method of claim 15, wherein the seal is manufactured as a single, integral structure separate from the body of the end cap.

17. The method of claim 16, further comprising coupling the body and the seal via an overmolding process.

18. The method of claim 11, wherein the end cap has a general T-shaped configuration with a narrower lower portion and a wider upper portion, the T-shaped configuration matching a corresponding profile of the mullion.

19. An assembly for a fenestration system comprising:

a frame including a frame member and a mullion;

an end cap including a body with a mullion-facing surface and an opposite frame-facing surface, the end cap seated against the mullion along the mullion-facing surface and seated against the frame along the frame-facing surface;

a seal coupled to the body of the end cap, the seal extending along a periphery of the body, the seal including one or more fastener bosses formed thereon, the one or more fastener bosses each having a passageway extending from the mullion-facing surface to the frame-facing surface when the seal is coupled to the body of the end cap;

one or more fasteners extending through the frame member, each fastener further extending through the passageway of a corresponding one of the one or more fastener bosses and into the mullion, wherein the fastener bosses each form a seal against the respective fastener when the frame, mullion, and end cap are coupled together; and the seal being a rubber seal coupled to the body via an overmolding process.

20. The assembly of claim 19, wherein the body of the end cap has a general T-shaped configuration with a narrower lower portion and a wider upper portion, the T-shaped configuration matching a corresponding profile of the mullion.

* * * * *